United States Patent [19]

von der Chys

[11] Patent Number: 4,617,221

[45] Date of Patent: Oct. 14, 1986

[54] SHEET OF ROOFCOVERING MATERIAL AND METHOD TO APPLY THIS SHEET IN OR AS A ROOFCOVERING

[76] Inventor: Lieuwe von der Chys, Schulstrasse 14, Bad-Hofgasstein, Austria

[21] Appl. No.: 677,133

[22] Filed: Nov. 30, 1984

[30] Foreign Application Priority Data

Dec. 2, 1983 [CH] Switzerland ..... 6470/83

[51] Int. Cl.[4] ..... B32B 3/10; B32B 17/06; B32B 11/10

[52] U.S. Cl. ..... 428/139; 427/186; 428/273; 428/284; 428/291; 428/489; 428/920

[58] Field of Search ..... 428/141, 143, 291, 489, 428/284, 139, 140, 198, 273, 920; 427/186

[56] References Cited

U.S. PATENT DOCUMENTS

| | | | |
|---|---|---|---|
| 1,015,919 | 1/1912 | Wardell | 428/140 |
| 1,278,270 | 9/1918 | Wilber | 428/139 |
| 1,788,121 | 1/1931 | Overbury | 428/140 |
| 2,392,239 | 1/1946 | Fasold et al. | 428/143 |
| 3,135,069 | 6/1964 | Schuller et al. | 428/139 |
| 4,343,847 | 8/1982 | Meynard | 428/143 |

*Primary Examiner*—Paul J. Thibodeau
*Attorney, Agent, or Firm*—Pollock, Vande Sande & Priddy

[57] ABSTRACT

Sheet of roofcovering material comprises a porous base-layer with apertures distributed over its surface. The base layer, at its upper side, is provided with a liquid- and/or vapor tight coating, onto which a bituminous adhering layer or a bituminous top layer has been applied.

6 Claims, 2 Drawing Figures

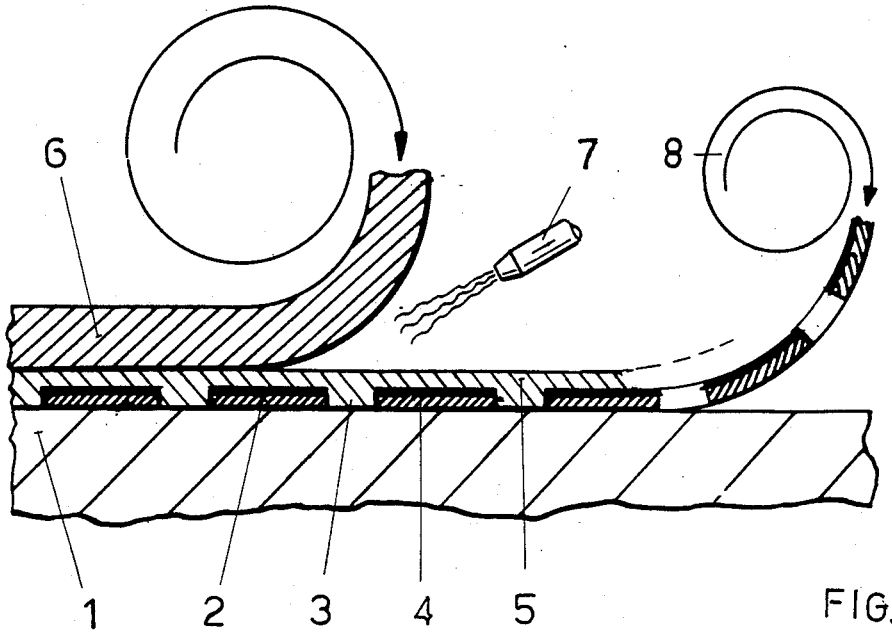
FIG. 1
FIG. 2
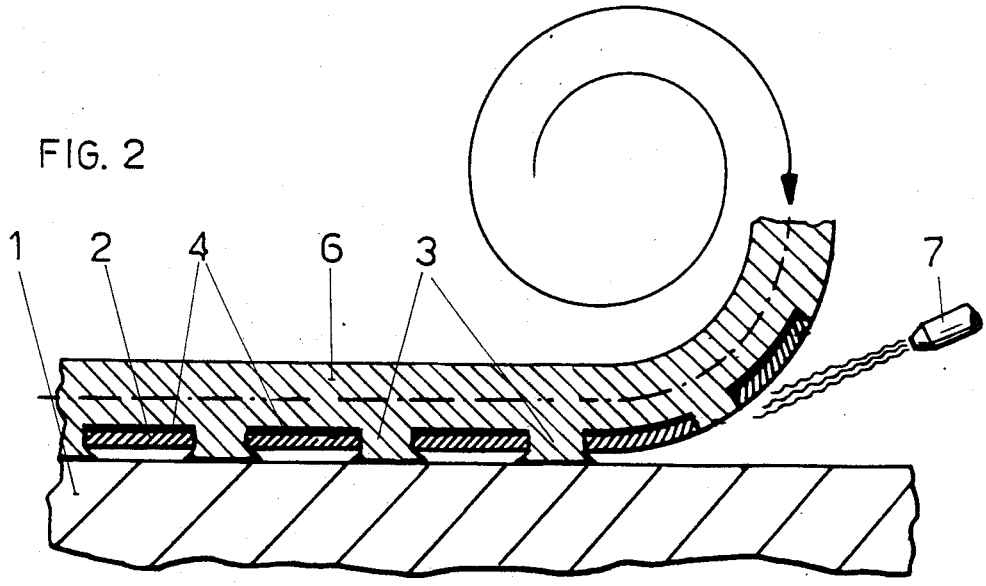

SHEET OF ROOFCOVERING MATERIAL AND METHOD TO APPLY THIS SHEET IN OR AS A ROOFCOVERING

BACKGROUND OF THE INVENTION

The present invention relates to a sheet of roof-covering material, comprising a base layer provided with apertures equally spaced over its surface.

Such a sheet is known in which the base layer by immersion is impregnated with bitumen and, on both sides, is provided with a bituminous coating.

In applying the sheet, the same is unrolled onto and over the roof plane, which may have been constructed from various materials, such as for instance wood or concrete, and after which hot and molten bitumen is spread out onto the sheet and caused to pass through the apertures to come into touch with and to adhere the sheet to the roof plane. After applying the sheet onto the roof plane, a top layer of bituminous material is unrolled onto and adhered to the upper side of the sheet to complete the roof-covering.

The known sheet of roof-covering material as described here above has the disadvantage of being impermeable for liquid and vapor, so that moisture enclosed between the sheet and the roof plane only can escape underneath the sheet to the surroundings and for which reason a granular material, such as fine gravel, may be applied underneath the sheet to keep it locally in spaced relationship with respect to the roof plane.

However, such granular material rather easily may penetrate into the roof-covering so that there is no way out any more for moisture enclosed underneath the sheet and which moisture, when being warmed up by sunshine, will cause the formation of blisters in the roof-covering.

Another disadvantage of the sheet known from the prior art is, that the hot and molten bitumen spread out onto the sheet to adhere it to the roof plane has to be cooled down before the top layer may be unrolled onto and over the sheet to complete the roof-covering.

It is an object of the present invention to obviate these disadvantages of the known sheet of roof-covering material.

SUMMARY OF THE PRESENT INVENTION

According to the present invention the sheet is characterized in that the base layer has a porous structure, particularly formed by glass fibers or glass fiber mat, the upper side of the porous base layer being provided with a liquid-and/or vapor-tight coating, over which coating a bituminous adhesive layer or a bituminous top layer has been applied, such, that when heating the sheet when the same has been applied onto a roof plane, the molten bitumen from the adhesive- or top layer will pass through the apertures of the base layer to come into touch with and to adhere the base layer to the roof plane, during which the coating prevents the molten bitumen from penetrating the porous base layer.

As distinct from the prior art sheet, the sheet according to the present invention, when applied in a roof-covering provides a porous layer situated immediately above the roof plane through which moisture in the form of liquid or vapor may escape to the surroundings to prevent formation of blisters in the roof-covering.

The apertures in the base layer may be left open by the adhesive- or top layer, or may be partly or completely filled up with the bituminous material from the adhesive- or top layer.

The liquid- and/or vapor-tight coating of the upper side of the base layer may consist of various materials.

According to an embodiment of the sheet according to the present invention, the coating consists of a heat-resistant, preferably fire-proof material.

In a preferred embodiment of the sheet, the coating has been applied loosely or in spaced relationship over the base layer.

The sheet according to the present invention may be applied as or in a roof-covering in various manners.

In a preferred embodiment, the sheet is unrolled onto the roof plane, after which onto and over it, the water-tight bituminous top layer is unrolled, during which the upper side of the adhesive bituminous layer of the sheet and the lower side of the top layer are heated immediately upstream of their junction to partly melt the bituminous material on both layers and then adhering both layers by continued unrolling of the top layer onto the base layer, during which operation the base layer is adhered to the roof plane by the molten bitumen flowing out through the apertures of the base layer onto the roof plane.

In another embodiment the sheet is provided with a thicker, bituminous top layer, and the sheet is unrolled onto the roof plane while its lower surface immediately upstream of its junction with the roof plane is heated to melt the bitumen and to cause it to flow out through the apertures of the base layer to come into touch with and to adhere the sheet to the roof plane.

The sheet of the present invention may be manufactured in various manners. The base layer may be provided at its upper side with a liquid- and/or vapor-tight coating, onto which molten bitumen is sprayed to form on the coating the adhesive bituminous layer or the thicker bituminous top layer the latter layer could be provided with an imbedded reinforcement web.

To that end, favourably an apparatus may be used which is provided with a movable supporting surface, preferably a conveyor belt, with means to bring the base layer from a storage roll onto the supporting surface, with means in the path of movement of the base layer to apply a liquid- and/or vapor-tight coating onto the upper side of the base layer, with means for feeding molten bitumen onto the coating, with means for cooling down the applied bitumen and with means to receive the completed sheet from the supporting surface.

In the accompanying drawing two embodiments of the sheet according to the invention and their application in or as a roof-covering are illustrated by way of example.

BRIEF DESCRIPTION OF THE DRAWINGS

FIG. 1 is a sectional view of the application of the sheet onto which an adhering layer of bituminous material is applied;

FIG. 2 is a sectional view of the application of the sheet as a complete roof-covering in which the base layer carries a thicker bituminous top layer.

DESCRIPTION OF THE PREFERRED EMBODIMENTS

As is shown in FIG. 1, the sheet is unrolled from the roll 8 onto the roof plane 1 to form a roof-covering thereon. The sheet consists of a porous base layer 2 of glass fiber mat, which is provided with apertures 3 equally spaced or distributed over its surface. Onto the base layer 2 a liquid-tight coating 4 is arranged and, over coating 4, the bituminous adhesive layer 5 is applied. After unrolling the sheet 2,4,5 onto the roof plane, the bituminous top layer 6 is unrolled onto the sheet 2,4,5 while, at the same time, the lower side of the top layer 6 and the upper side of the sheet 2,4,5 are heated immediately upstream of their junction by means of the burner 7. By this heating the bitumen of the adhesive layer melts and flows through the apertures 3 to come into touch with and to adhere the sheet to the roof plane 1, while, at the same time, the adhesive bituminous layer 5 at its upper side and the top layer 6 at its lower side are molten to adhere to each other during continuous unrolling of the top layer 6 onto the sheet 2,4,5.

As is shown in FIG. 2, the porous base layer is provided with a liquid-tight coating 4 and is further provided with a thicker top layer 6, which, together with the base layer 2 is unrolled onto the roof plane.

During that operation, the base layer 2 is heated at its lower side, causing the bitumen of the top layer to melt and to flow through the apertures 3 to come into touch with and to adhere the sheet to the roof plane.

I claim:

1. A sheet member, used as a roof-covering material comprising:

a first base layer having portions made of a porous material and having a plurality of apertures throughout disposed between said portions of porous material, said base layer having a lower and an upper surface, said lower surface to be applied on a roof;

a second layer of moisture-tight coating disposed over said upper surface of said porous portion of said base layer; and a third layer of bituminous material disposed on the upper surface of said second layer, whereby said sheet member is adapted for attachment to the roof by heating said third layer of bituminous material while disposing it over said second layer to cause a flow of the molten bitumen from said third layer through said apertures in said base layer to firmly attach said sheet to the roof surface at the locations of said apertures, said flow of said bitumen being prevented from penetrating said porous material portion of said base layer by said second layer whereby the porous base layer allows escape of the vapor trapped under the sheet member to the surrounding and prevents formation of blisters in said sheet member.

2. A sheet member as claimed in claim 1 wherein said third layer is a bituminous adhesive layer.

3. A sheet member as claimed in claim 1 wherein said porous material is glass fiber or glass fiber mat.

4. A sheet member as claimed in claims 1 or 2 wherein said apertures are at least partially filled by said bituminous material.

5. A sheet member as claimed in claim 1 wherein said second layer is a heat-resistant or fire-proof material.

6. A sheet member as claimed in claim 1 further comprising a layer of a bituminous adhesive material disposed between said second and said third layers.

* * * * *